US008544202B2

(12) United States Patent
Bastian, Jr.

(10) Patent No.: US 8,544,202 B2
(45) Date of Patent: Oct. 1, 2013

(54) SHOOTING REST ASSEMBLY

(75) Inventor: David B. Bastian, Jr., Alma, MI (US)

(73) Assignee: Demonic Buck Hunting Products LLC, Alma, MI (US)

( * ) Notice: Subject to any disclaimer, the term of this patent is extended or adjusted under 35 U.S.C. 154(b) by 0 days.

(21) Appl. No.: 13/547,798

(22) Filed: Jul. 12, 2012

(65) Prior Publication Data

US 2013/0014420 A1 Jan. 17, 2013

Related U.S. Application Data

(60) Provisional application No. 61/572,122, filed on Jul. 12, 2011, provisional application No. 61/575,977, filed on Sep. 1, 2011.

(51) Int. Cl.
*F41C 27/00* (2006.01)

(52) U.S. Cl.
USPC ..... 42/94; 89/37.01; 89/37.03; 89/37.04

(58) Field of Classification Search
USPC ..... 42/94; 89/37.01, 37.03, 37.04, 37.13, 89/37.14
See application file for complete search history.

(56) References Cited

U.S. PATENT DOCUMENTS 2,228,179 A * 1/1941 Motley ..... 89/37.03
2,346,692 A * 4/1944 Lucht ..... 89/44.02
2,870,683 A * 1/1959 Wilson ..... 89/40.06
4,007,554 A 2/1977 Helmstadter
4,409,751 A 10/1983 Goda et al.
4,823,673 A * 4/1989 Downing ..... 89/37.04
4,937,965 A * 7/1990 Narvaez ..... 42/94
4,967,497 A 11/1990 Yakscoe
5,081,783 A * 1/1992 Jarvis ..... 42/94
5,272,955 A * 12/1993 Bond et al. ..... 89/37.04
5,481,817 A * 1/1996 Parker ..... 248/286.1
5,628,135 A * 5/1997 Cady ..... 42/94
D382,035 S 8/1997 Swicegood
5,723,808 A * 3/1998 Devall ..... 89/37.04
5,778,589 A 7/1998 Teague
5,933,999 A * 8/1999 McClure et al. ..... 42/94
6,269,578 B1 * 8/2001 Callegari ..... 42/94
6,286,411 B1 * 9/2001 Sanderson ..... 89/37.16

(Continued)

OTHER PUBLICATIONS

Cabela'S 2012 Shooting catalog, Accessories/Shooting Sticks, Cover and p. 124, available at least as early as Aug. 31, 2012, 2 pages.

(Continued)

*Primary Examiner* — Samir Abdosh
*Assistant Examiner* — Derrick Morgan
(74) *Attorney, Agent, or Firm* — Howard & Howard Attorneys PLLC

(57) ABSTRACT

A shooting rest assembly is engageable with a stand for supporting a weapon in the stand. The shooting rest assembly includes a base having at least one clamp for coupling to the stand. A platform is rotatably coupled to the base and has a platform frame and a telescoping member telescopically coupled to the platform frame. The telescoping member is configured to move along a longitudinal axis relative to the platform frame between a retracted position and an extended position. A front rest and a rear rest are spaced along the longitudinal axis and are mounted to the telescoping member in fixed positions so that each of the front rest and the rear rest move with the telescoping member as the telescoping member moves along the longitudinal axis between the retracted and extended positions relative to the longitudinal axis.

22 Claims, 9 Drawing Sheets

(56) References Cited

U.S. PATENT DOCUMENTS

| | | | | |
|---|---|---|---|---|
| 6,574,899 | B1 * | 6/2003 | Mostello | 42/94 |
| 7,536,820 | B2 * | 5/2009 | Wade et al. | 42/94 |
| 7,549,247 | B1 * | 6/2009 | Reese | 42/94 |
| 7,730,824 | B1 * | 6/2010 | Black | 89/37.03 |
| 8,109,028 | B2 * | 2/2012 | Roberts et al. | 42/94 |
| 8,245,431 | B2 * | 8/2012 | Werner | 42/94 |
| 2004/0134113 | A1 * | 7/2004 | Deros et al. | 42/94 |
| 2004/0237372 | A1 * | 12/2004 | Frye | 42/94 |
| 2006/0248775 | A1 * | 11/2006 | Wade et al. | 42/94 |
| 2006/0254114 | A1 * | 11/2006 | Lehman | 42/94 |
| 2008/0202326 | A1 * | 8/2008 | Carroll et al. | 89/38 |
| 2009/0188146 | A1 * | 7/2009 | Werner | 42/94 |
| 2010/0126338 | A1 * | 5/2010 | Rastegar et al. | 89/37.13 |
| 2010/0223832 | A1 * | 9/2010 | Lombardi | 42/94 |
| 2011/0197748 | A1 * | 8/2011 | Roberts et al. | 89/37.04 |
| 2012/0227305 | A1 * | 9/2012 | Fontenot et al. | 42/94 |

OTHER PUBLICATIONS

Caldwell Shooting Supplies, DeadShot FieldPod, Usage and Maintenance Instructions, Product available at least as early as Jun. 1, 2011, 8 pages.

Oaksturdy, Vital Shot Gun Rest, http://oaksturdy.com/wp/products-for-sale/tree-stand-bench-rest/, accessed on Apr. 20, 2012, 1 page.

Oaksturdy Hunting Products, Vital Shot Gun Rest, http://oaksturdy.com/search?q=vital+shot+gun+rest, accessed on Nov. 20, 2012, 3 pages.

* cited by examiner

SHOOTING REST ASSEMBLY

RELATED APPLICATION

This application claims priority to and all advantages of U.S. Provisional Patent Application No. 61/572,122 filed on Jul. 12, 2011, and U.S. Provisional Patent Application No. 61/575,977 filed on Sep. 1, 2011, both of which are incorporated herein by reference.

BACKGROUND OF THE INVENTION

1. Field of the Invention

The subject invention generally relates to a shooting rest assembly for supporting a weapon on a stand, such as, for example, a hunting blind.

2. Description of Related Art

Blinds, including stands, elevated stands, etc., are used by hunters to conceal their presence from game animals. For example, elevated stands are elevated above the ground to remove the hunter from a line of sight of game animals. Elevated stands typically have a seat and/or a foot rest to support the occupant of the elevated stand. Some elevated stands have one or more guard rails that extend at least partially around the occupant to assist in retaining the occupant in the elevated stand. Elevated stands of various brands and manufacturers have varying shapes, sizes, and configurations of guard rails. Further, some hunters choose to manufacture their own homemade elevated stands. The varying shapes, sizes, and configurations of guard rails create difficulties in manufacturing aftermarket components that attach to the guard rails.

Elevated stands typically do not include features that support a weapon. As such, the weapon is typically held by the occupant of the elevated stand or leaned against the guard rail. In any event, when a game animal approaches, the occupant must raise the weapon, which may disadvantageously attract the attention of the game animal. Also, in some situations, the occupant can steady the weapon on the guard rail; however even in such situations, the occupant typically must assume an awkward position to do so.

As such, there remains an opportunity to develop a shooting rest assembly for supporting a weapon in a stand. There also remains an opportunity to develop a shooting rest assembly having multiple ranges of motion for supporting a weapon when the weapon is being partly supported and aimed and when the weapon is completely at rest on the shooting rest assembly, i.e., unsupported by the occupant.

SUMMARY OF THE INVENTION AND ADVANTAGES

The subject invention provides for a shooting rest assembly for supporting a weapon on a stand. The shooting rest assembly includes a base having at least one clamp for coupling the base to the stand. A platform is rotatably coupled to the base and has a platform frame and a telescoping member telescopically coupled to the platform frame. The telescoping member is configured to move along a longitudinal axis relative to the platform frame between a retracted position and an extended position. A front rest and a rear rest are spaced along the longitudinal axis and are mounted to the telescoping member in fixed positions so that each of the front rest and the rear rest move with the telescoping member as the telescoping member moves along the longitudinal axis between the retracted and extended positions relative to the longitudinal axis.

The shooting rest advantageously holds the weapon to reduce the risk of dropping the weapon from the elevated stand. By holding the weapon, the shooting rest also frees the hands of the occupant so that the occupant can, for example, more easily relax and/or can operate game calls or other game attractants. The shooting rest also holds the weapon in a convenient location relative to the occupant such that the occupant can quickly and easily access the weapon with limited movement. Further, by supporting the weapon with the front rest, the weapon is steadied to increase the accuracy of the shot at the target.

Since the platform is rotatable relative to the base and the telescoping member telescopes relative to the platform frame, the occupant can rotate the platform relative to the base and telescope the telescoping member relative to the platform frame by lifting a butt end of the weapon from the rear rest and exerting force on the front rest with a front end of the weapon. Since the front rest and the rear rest are mounted to the telescoping member in fixed positions, a constant space is maintained between the front rest and the rear rest even as the platform rotates relative to the base and as the telescoping member moves along the longitudinal axis relative to the platform frame between the retracted and extended positions. As such, when the occupant raises the butt end of the weapon from the rear rest and then rotates the platform relative to the base and/or telescopes the telescoping member relative to the platform frame by exerting force on the front rest with the front end of the weapon, the front rest and the rear rest remain spaced by the constant distance. Regardless of the position of the telescoping member relative to the platform frame, the occupant merely lowers the butt end of the weapon onto the rear rest to release the weapon on the shooting rest assembly. In other words, the front rest and the rear rest remain properly spaced to support the weapon regardless of the position of the telescoping member relative to the platform frame.

BRIEF DESCRIPTION OF THE DRAWINGS

Advantages of the subject invention will be readily appreciated as the same becomes better understood by reference to the following detailed description when considered in connection with the accompanying drawings.

DETAILED DESCRIPTION OF THE INVENTION

Referring to the Figures, wherein like numerals indicate like or corresponding parts throughout the several views, a shooting rest assembly 20 supports a weapon 22 on a stand 24. The stand 24 can, for example, a hunting blind. The stand 24 can be a ground stand or an elevated stand. The stand 24 is typically elevated above ground in an attempt to remove an occupant 26 from a line of sight of a game animal (not shown). However, it should be appreciated that the stand 24 can be configured to be coupled to a tripod or any other ground-level stand to support the weapon 22 for aiming at a target such as a game animal. In the case of an elevated stand, the stand 24 can be anchored to a tree and in such scenarios can be referred to in the industry as a tree stand. Alternatively, or in addition to being supported by a tree, the stand 24 can be supported by stilts. For simplicity of the Figures, the stand 24 is not shown in the tree or on the stilts.

Figure 8:
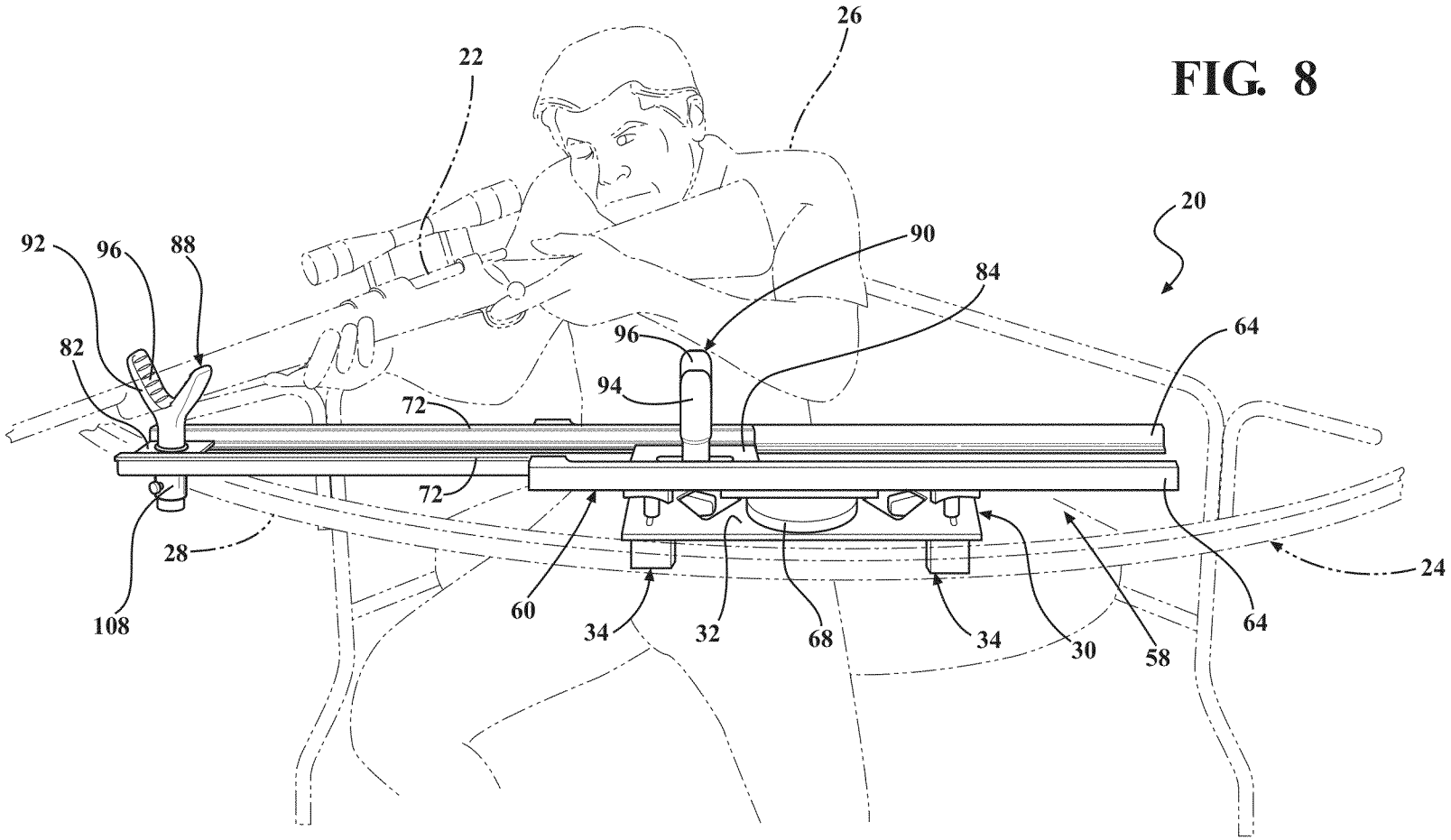
FIG. 8 is a perspective view of the shooting rest assembly supporting the weapon aimed in a second direction, specifically to the right of the occupant.
Figure 9:
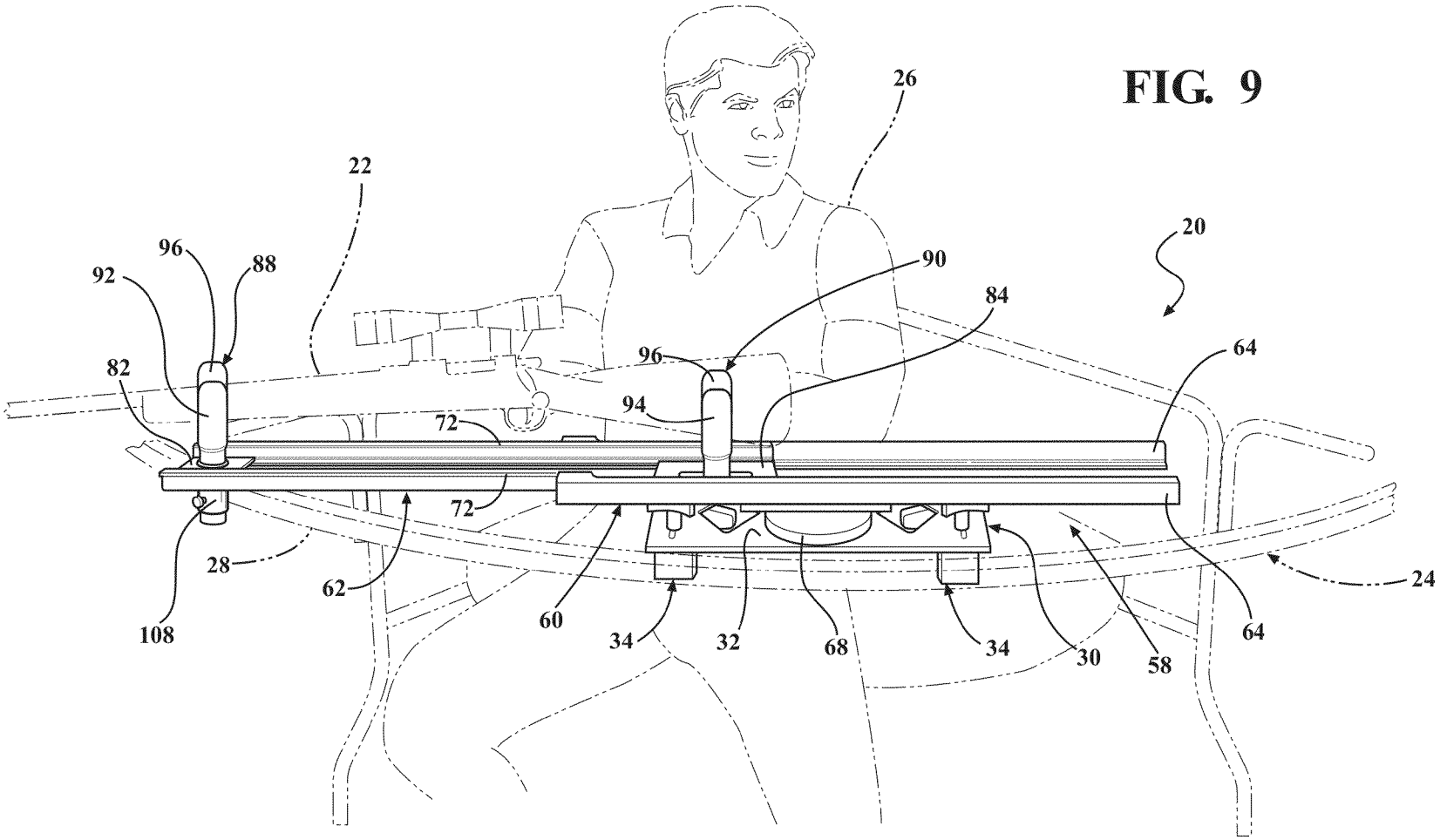
FIG. 9 is a perspective view of the shooting rest assembly having a platform frame in an extended position and fully supporting the weapon with the weapon aimed to the right of the occupant.
Figure 10:
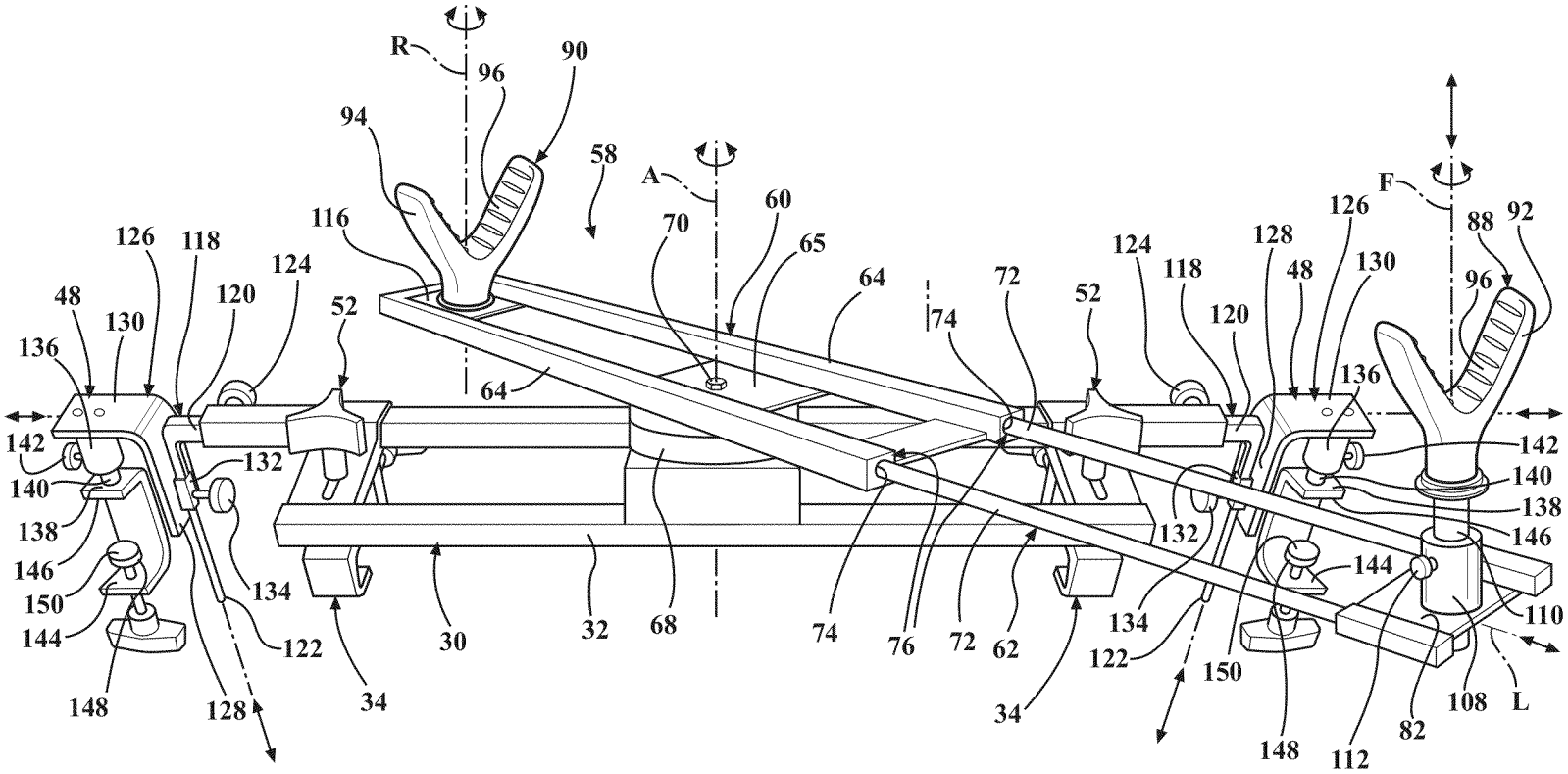
FIG. 10 is a perspective view of a second embodiment of the shooting rest assembly.

A first embodiment of the shooting rest assembly 20, 114 is shown in FIGS. 1-9 and a second embodiment of the shooting rest assembly 114 is shown in FIG. 10. Like numerals indicate like or corresponding parts in FIGS. 1-9 and FIG. 10.

The shooting rest assembly 20 is configured to be coupled to the stand 24, as shown in FIGS. 6-9 and to support the weapon 22 for aiming at the target, such as a game animal. The game animal can, for example, be white-tailed deer or any other type of game animal hunted in the stand 24.

For exemplary purposes, the weapon 22 is shown in FIGS. 6-9 as a long barreled firearm, i.e., a gun. It should be appreciated that the weapon 22 can be a cross-bow or any type of weapon 22 that can be supported by the shooting rest assembly 20 without departing from the nature of the present invention.

With reference to FIGS. 5-9, the stand 24 typically includes at least one guard rail 28 extending at least partially around the occupant 26 to assist in retaining the occupant 26 in the stand 24. It should be appreciated that the guard rail 28 can include one, two, three, or more segments and each segment can have the same or varying sizes and configurations. For example, as shown in the Figures, the guard rail 28 includes two straight segments and a curved segment extending from one straight segment to the other straight segment. As will be discussed in greater detail below, the shooting rest assembly 20, 114 is configured to be adapted to a variety of guard rails 28 of various sizes and configurations. As such, the shooting rest assembly 20, 114 can be used with a variety of stands 24 manufactured by various manufacturers as well as stands 24 that are homemade. It should be appreciated that the stand 24 shown in FIGS. 6-9 is shown for exemplary purposes and the stand 24 can be of any type, size, and shape without departing from the nature of the present invention.

Figure 4:
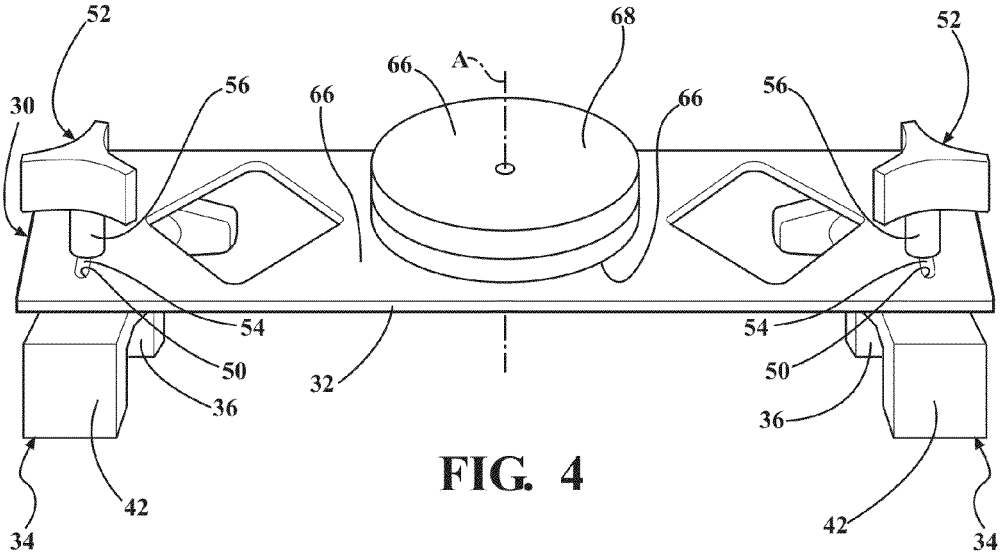
FIG. 4 is a perspective view of a base of the shooting rest assembly.
Figure 5:
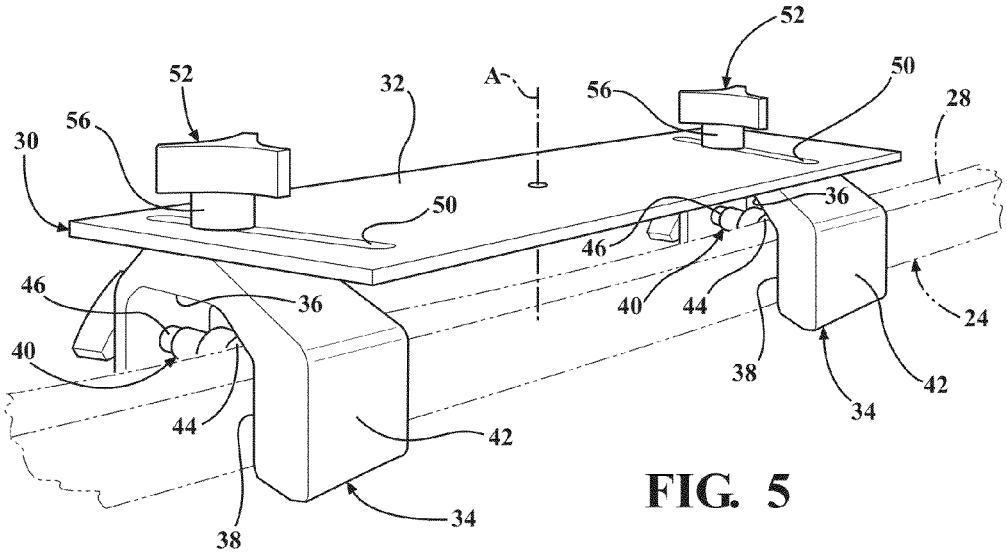
FIG. 5 is a side perspective view of the base engaging a stand.

With reference to FIGS. 4 and 5, the shooting rest assembly 20 includes a base 30. The base 30 has a base frame 32 extending to distal ends. The base frame 32 typically has a planar configuration. However, it should be appreciated that the base frame 32 can be any suitable configuration.

The base 30 has at least one clamp 34 for coupling the base 30 to the stand 24. As shown in FIGS. 4 and 5, for example, the base 30 has two clamps 34 spaced from each other. The two clamps 34 shown in FIGS. 4 and 5 are, for example, disposed at the distal ends of the base frame 32. It should be appreciated that the base 30 can include any number of clamps 34, i.e., one or more, for coupling the shooting rest assembly 20 to the stand 24.

As shown in FIG. 5, the clamp 34 defines a channel 36 for receiving a portion of the stand 24. More specifically, in the exemplary embodiment the channel 36 of the clamp 34 receives the guard rail 28 of the stand 24. The clamp 34 has a tightening surface 38 disposed in the channel 36 and a tightening member 40 extending into the channel 36 opposite the tightening surface 38 for sandwiching the stand 24 between the tightening member 40 and the tightening surface 38. More specifically, the clamp 34 has a jaw 42 defining the channel 36 and the tightening member 40 extends through the jaw 42 into the channel 36. The tightening member 40 has a compressing surface 44 opposing the tightening surface 38. The tightening member 40 has a threaded post 46 extending from the tightening member 40 transverse to the compressing surface 44 and threadedly engaging the jaw 42 opposite the tightening surface 38 of the clamp 34. Said differently, the tightening member 40 is coupled to the jaw 42 and is translatable within the jaw 42 towards and away from tightening surface 38 as the tightening member 40 is rotated relative the threaded post 46. The tightening member 40 is shown in the Figures as a threaded member that threadedly engages the jaw 42; however, it should be appreciated that the tightening member 40 can be any type of suitable locking device without departing from the nature of the present invention.

With the guard rail 28 of the stand 24 disposed within the channel 36 of the clamp 34, the tightening member 40 is movable towards from the tightening surface 38 such that both the compressing surface 44 and the tightening surface 38 engage the guard rail 28. With the guard rail 28 disposed between and engaged by each of the compressing surface 44 and the tightening surface 38, the threaded engagement of the threaded post 46 with the jaw 42 maintains the engagement of the compressing surface 44 and the tightening surface 38 with the guard rail 28 for coupling the base 30 to the stand 24.

Although not shown in FIGS. 1-9, the first embodiment of the shooting rest assembly 20 can include a pair of telescoping distal clamps 48 positioned at each of the distal ends of the base frame 32, as shown in the second embodiment of the shooting rest assembly 114 in FIG. 10. The distal clamps 48 are discussed in greater detail below.

The clamp 34 is adjustable relative to the base 30. The base 30 defines a slot 50 and the clamp 34 includes a locking member 52 extending through the slot 50 to selectively adjust and fix the clamp 34 relative to the base 30. More specifically, the base frame 32 defines two slots 50 spaced from each other, i.e., one for each clamp 34 shown in FIGS. 4 and 5.

The locking member 52 extends away from the jaw 42 of the clamp 34. The locking member 52 includes a threaded rod 54 and a clamping nut 56 for clamping the base frame 32 between the jaw 42 of the clamp 34 and the clamping nut 56. The threaded rod 54 is fixed to one of the clamping nut 56 and the jaw 42 and is threadedly engaged with the other of the clamping nut 56 and the jaw 42. The locking member 52 is tightened or loosened relative to the base frame 32 by rotating the threaded rod 54 relative to the other of the clamping nut 56 and the jaw 42.

The threaded rod 54 extends through the slot 50 of the base frame 32 and is movable along the slot 50 when the locking member is loosened relative to the base frame 32. As such, when the clamping nut 56 and the jaw 42 are loosened relative to each other, the clamp 34 is adjustable within the slot 50 relative to the base frame 32 to reposition the clamp 34 relative to the base frame 32. The adjustability of the clamp 34 within the slot 50 relative to the base frame 32 allows the base 30 of the shooting rest assembly 20 to couple to various configurations of the guard rails 28 of the stand 24.

To secure each of the clamps 34 relative to the base frame 32, the clamping nut 56 is rotated relative to the base 30 frame 32 to pinch the base frame 32 between the clamping nut 56 and the jaw 42. The jaw 42 and the clamping nut 56 engage the base frame 32 proximate the slot 50 to secure the clamp 34 relative to the base frame 32. The locking member 52 as shown in the Figures includes the threaded rod 54 and the clamping nut 56, however, it should be appreciated that the locking member 52 can be any type of suitable locking device without departing from the nature of the present invention.

In the alternative or in addition to the clamps 34, the base frame 32 can be directly mounted to the guard rail 28. In such an embodiment, the base frame 32 and the guard rail 28 define a plurality of holes (not shown) with a plurality of fasteners extending through the holes to directly mount the base frame 32 to the guard rail 28. Alternatively, it should be appreciated that the base frame 32 can be directly connected to the guard rail 28 by any other suitable configuration such as, but not limited to, welding, straps, etc.

Figure 3:
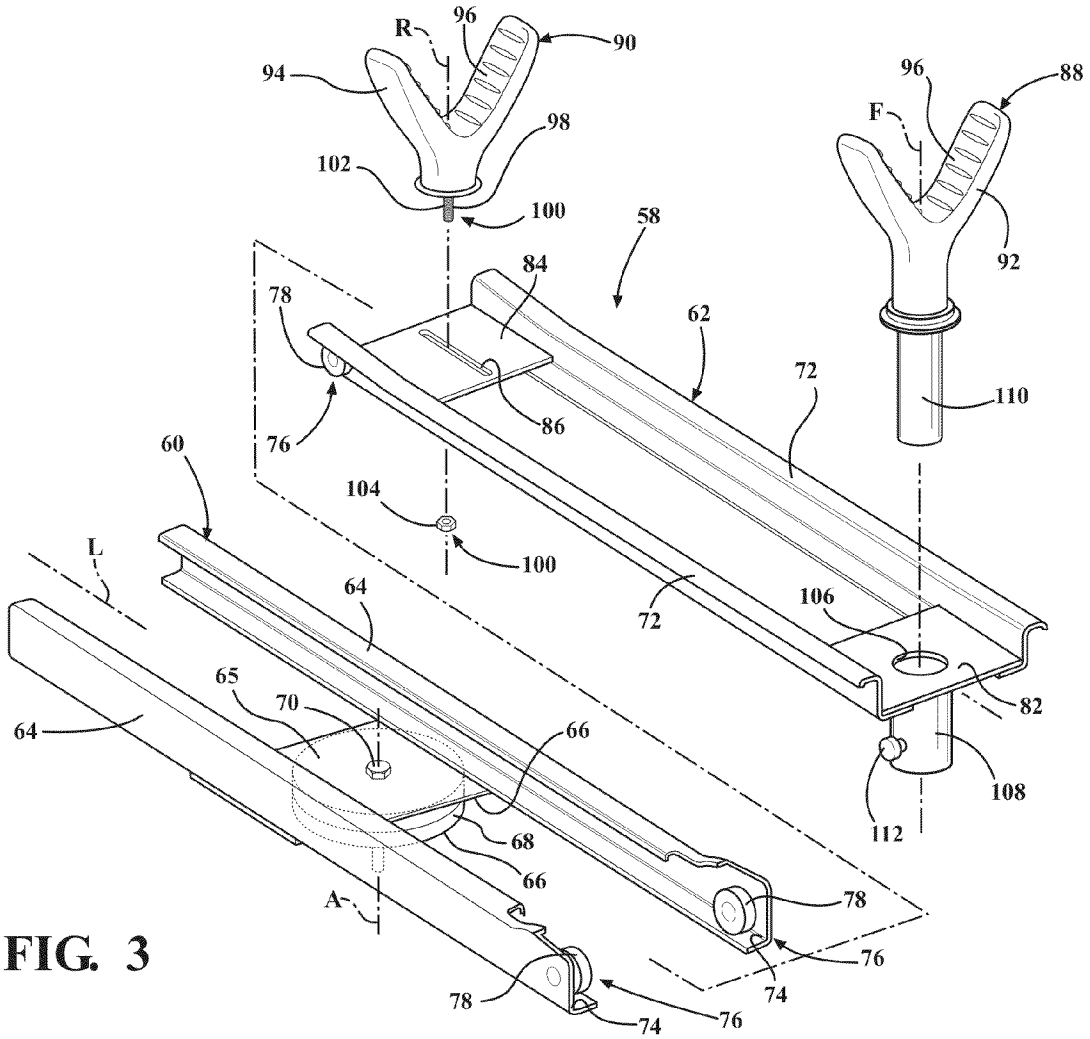
FIG. 3 is a partially exploded view of a platform of the shooting rest assembly.

With reference to FIG. 3, the shooting rest assembly 20 includes a platform 58. The platform 58 is disposed above the base 30 opposite the clamps 34. The platform 58 has a platform frame 60 and a telescoping member 62 telescopically coupled to the platform frame 60.

The platform frame 60 includes a rail 64. For example, in the embodiments shown in the Figures, the rail 64 is further defined as two rails 64 spaced from one another. When including more than one rail 64, the platform frame 60 includes at least one plate 65 extending between and fixed to each of the rails 64. It should be appreciated that the plate 65 can be fixed to the rails 64 by welding, gluing, mechanical fasteners, or by any other suitable configuration.

Figure 1:
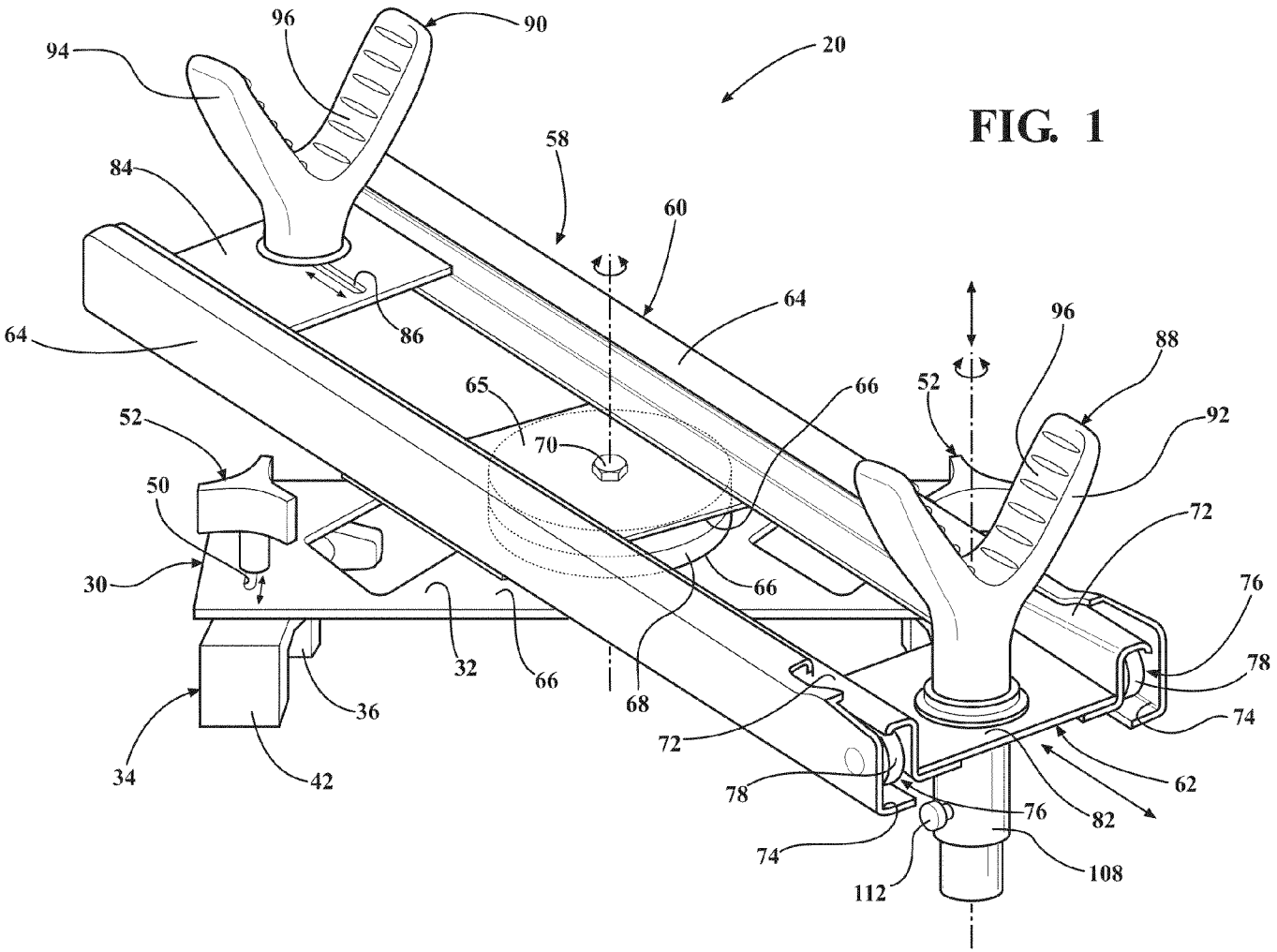
FIG. 1 is a perspective view of a shooting rest assembly.

As shown in FIG. 1, the platform 58 is rotatably coupled to the base 30. More specifically, the shooting rest assembly 20 further includes a rotational axis A extending through the platform 58 and the base 30. Each of the platform 58 and the base 30 has a corresponding surface 66 about the rotational axis A with the corresponding surfaces 66 abutting each other for supporting the platform 58 on the base 30 in various rotational positions. Said differently, the corresponding surface 66 of the platform 58 is disposed on the plate 65 of the platform frame 60 and the corresponding surface 66 of the base 30 is disposed on the base frame 32.

Typically, the shooting rest assembly 20 includes a spacer 68 disposed about the rotational axis A between the platform 58 and the base 30 with the spacer 68 rotatably supporting the platform 58 on the base 30. Specifically, one of the base 30 and the platform 58 includes the spacer 68. In the embodiment shown in the Figures, the spacer 68 is a separate unit relative to the base 30 and the platform 58 and is rotatable relative to both the platform 58 and the base. The spacer 68 presents one of the corresponding surfaces 66. Specifically, the spacer 68 presents two corresponding surfaces 66 opposing each other, with one of the corresponding surfaces 66 adjacent the platform 58 and one of the corresponding surfaces 66 adjacent the base 30.

Figure 2:
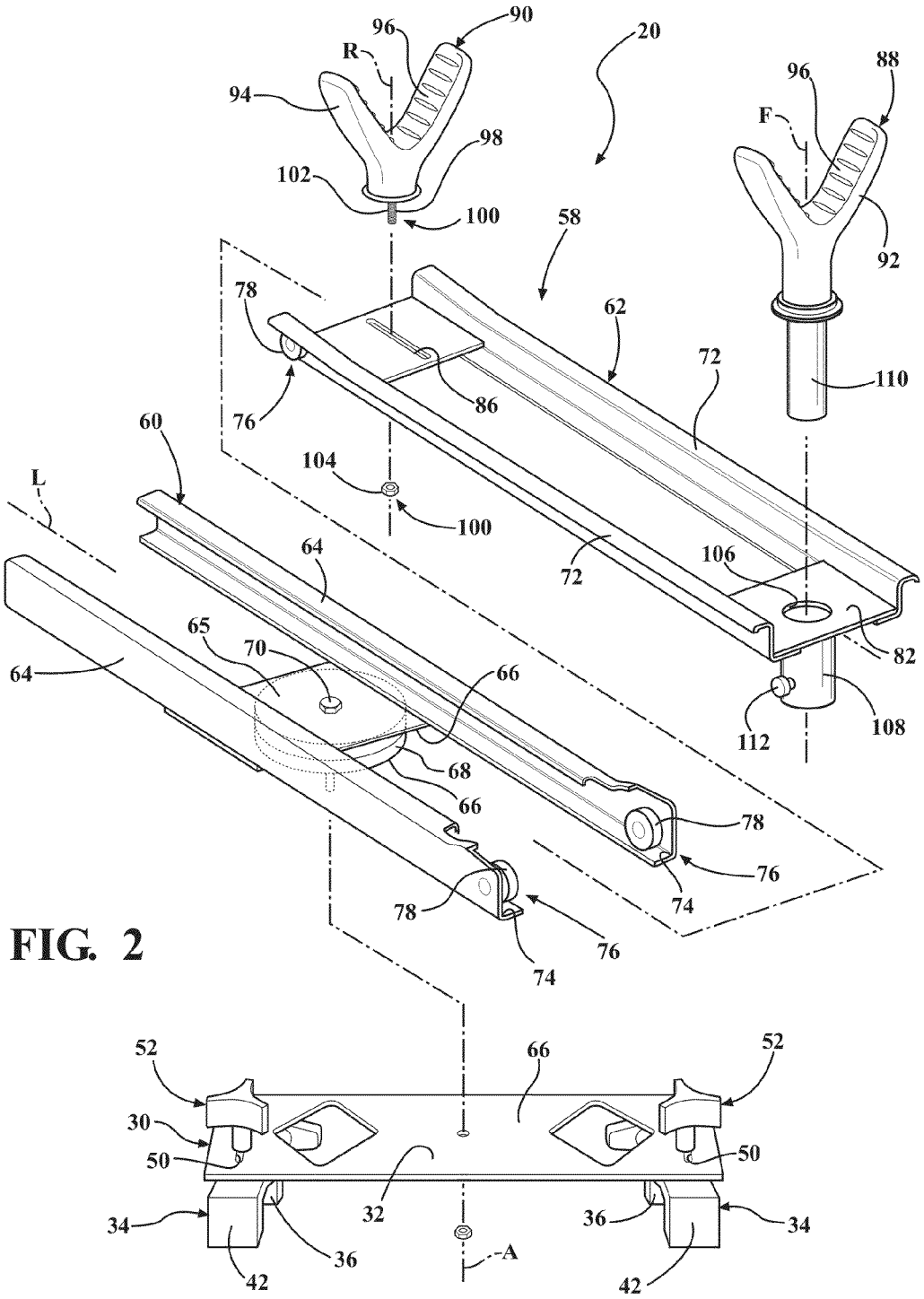
FIG. 2 is a partially exploded view of the shooting rest assembly.

As shown in FIGS. 1 and 2, the shooting rest assembly 20 includes a pin 70 coupling the platform 58 and the base 30 along the rotational axis A. The pin 70 is rotatably coupled with at least one of the platform 58 and the base 30. Said differently, the pin 70 extends along the rotational axis A through each of the plate 65 of the platform frame 60, the spacer 68, and the base frame 32. Each of the plate 65 of the platform frame 60, the spacer 68, and the base frame 32 are rotatable about the pin 70 along the rotational axis A. The pin 70 can be fixed the base frame 32 such that the spacer 68 and the plate 65 of the platform frame 60 rotate about the pin 70 along the axis A. Alternatively, the pin 70 can be fixed to the plate 65 of the platform frame 60 such that the spacer 68 and the base frame 32 rotate about the pin 70 along the axis A. However, the pin 70 can be any configuration for rotatably coupling the platform 58 to the base 30.

Figure 6:
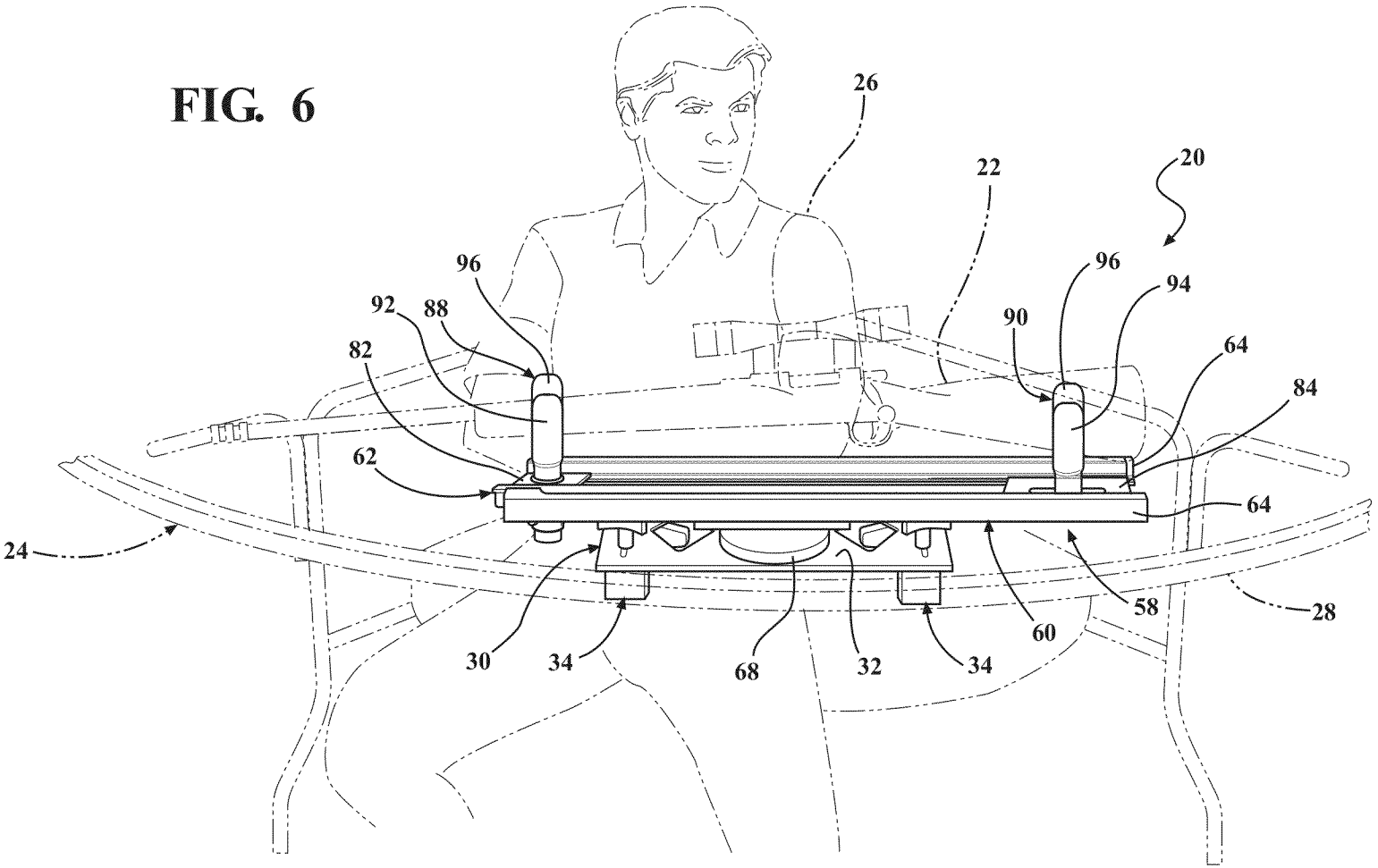
FIG. 6 is a perspective view of the shooting rest assembly in a retracted position and fully supporting the weapon.

The telescoping member 62 is configured to move along a longitudinal axis L relative to the platform frame 60 between a retracted position shown in FIG. 6, and an extended position, shown in FIGS. 8 and 9. The telescoping member 62 includes an elongated member 72 telescopically engaging the rail 64. In the embodiment shown in the Figures, the elongated member 72 is further defined as two elongated members 72, i.e., each telescopically engaging the rails 64, respectively. Each of the rails 64 define a track 74 such that each rail 64 receives one of the elongated members 72 within the track 74.

With reference to FIGS. 2 and 3, the shooting rest assembly 20 further includes an anti-friction device 76 disposed between the platform frame 60 and the telescoping member 62 for reducing friction between the platform frame 60 and the telescoping member 62. In the exemplary embodiment, the anti-friction device 76 is a plurality of wheels 78 rotatably coupled to each of the rails 64 of the platform frame 60 and the elongated members 72 of the telescoping member 62. Alternatively, the anti-friction device 76 can be a rod and bearing fit between the elongated members 72 and the rails 64 as shown generally in FIG. 10. Alternatively, the anti-friction device 76 can be any type of anti-friction device such as, for example, a nylon sleeve or nylon ball bearings disposed between the elongated members 72 and the rails 64 or any other suitable anti-friction device for reducing friction between the platform frame 60 and the telescoping member 62.

As shown in FIGS. 1-3, the telescoping member 62 includes at least one crossmember 82, 84 disposed between and fixed to the elongated members 72. More specifically, the at least one crossmember 82, 84 is further defined as a front crossmember 82 and a rear crossmember 84 disposed at opposite distal ends of the elongated members 72. The telescoping member 62 defines an aperture 86 elongated along the longitudinal axis L. More specifically, the rear crossmember 84 of the telescoping member 62 defines the aperture 86.

The shooting rest assembly 20 includes a front rest 88 and a rear rest 90 spaced along the longitudinal axis L and mounted to the telescoping member 62 in fixed positions. The front rest 88 is mounted to the front crossmember 82 of the telescoping member 62 and the rear rest 90 is mounted to the rear crossmember 84 of the telescoping member 62.

The front rest 88 is typically permanently fixed in a single position along the longitudinal axis L, i.e., the front rest 88 is not adjustable along the longitudinal axis L. The rear rest 90 is typically adjustable between a plurality of the fixed positions relative to the longitudinal axis L. As set forth further below, the telescoping member 62 and the rear rest 90 are configured to retain the rear rest 90 in one of the plurality of the fixed positions. The rear rest 90 is selectively retained in one of the plurality of fixed positions for maintaining a constant distance between the front rest 88 and the rear rest 90 as the telescoping member 62 moves relative to the platform 58 between the retracted position and the extended position to support the weapon 22 at any position between the retracted position and the extended position.

The front rest 88 includes a front support 92 and the rear rest 90 includes a rear support 94. The front and rear supports 92, 94 are disposed above the front and rear crossmembers 82, 84, opposite the base frame 32. Both the front and rear supports 92, 94 have a "Y" configuration with each of the front and rear supports 92, 94 defining a crotch 96 for supporting the weapon 22 within. It should be appreciated that the front and rear rests 88, 90 can include a strap disposed across the crotch 96 of the front and rear supports 92, 94 to secure the weapon 22 within the crotch 96.

The rear rest 90 includes a post 98 slidably received in the aperture 86 and capable of moving between the fixed positions. The rear rest 90 includes a rear rest axis R transverse to the longitudinal axis L. The post 98 extends from the rear support 94 of the rear rest 90 through the aperture 86 of the rear crossmember 84.

The shooting rest assembly 20 further includes a locking mechanism 100 coupled to at least one of the telescoping member 62 and the rear rest 90. The locking mechanism 100 is movable between a locked position for fixing the rear rest 90 in one of the plurality of the fixed positions and an unlocked position for adjusting the rear rest 90 between the plurality of the fixed positions relative to the longitudinal axis L.

The locking mechanism 100 includes a threaded surface 102 and a threaded nut 104 threadedly engaging the threaded surface 102. In the exemplary embodiment, the threaded surface 102 is disposed on the post 98 of the rear rest 90 with the threaded nut 104 disposed below the rear crossmember 84 opposite the rear support 94. The threaded nut 104 threadedly engages the threaded surface 102 of the post 98 and is movable between the locked position in which the threaded nut 104 abuts the rear crossmember 84 and the unlocked position in which the threaded nut 104 is spaced from the rear crossmember 84. In the locked position, both the threaded nut 104 and the rear support 94 abut the rear crossmember 84 to fix the rear rest 90 in one of the fixed positions.

Alternatively, it should be appreciated that the locking mechanism 100 can be any type of locking mechanism that locks the rear rest 90 to the telescoping member 62. For example, the locking mechanism can include a bushing disposed around the post 98 and positioned within the aperture 86 to create a friction fit between the post 98 and the aperture 86. In such an embodiment, the friction fit between the bushing and the rear crossmember 84 can be overcome to move the rear rest 90 within the aperture 86 between the plurality of fixed positions.

The constant distance between the front and rear rests 88, 90 is selectively adjusted by adjusting the position of the rear rest 90 relative to the telescoping member 62. For example, the occupant can adjust the constant distance between the rear rest 90 and the front rest 88 to accommodate a size of a weapon of choice. Typically, the constant distance is selected and the locking mechanism 100 is moved to the locked position prior to operating the shooting rest assembly 20.

The front rest 88 includes a front rest axis F transverse to the longitudinal axis L with the front rest 88 adjustable along the front rest axis F. The front crossmember 82 defines a hole 106 disposed along the front rest axis F and a sleeve 108 disposed about the hole 106 below the front crossmember 82, opposite the front support 92. The sleeve 108 is fixed to the front crossmember 82, for example, by welding, gluing, mechanical fasteners, or by any other suitable configuration.

The front rest 88 includes a rod 110 extending along the front rest axis F into the hole 106 of the front crossmember 82 and the sleeve 108. The rod 110 is adjustable along the front rest axis F for positioning the front rest 88 between a plurality of heights relative to the front crossmember 82.

The front rest 88 typically includes a set screw 112 extending through the sleeve 108 and selectively engaging the rod 110 to lock the front rest 88 in one of the plurality of heights. Said differently, the set screw 112 is tightened to lock the front rest 88 in one of the plurality of heights and is loosened to adjust the front rest 88 between one of the plurality of heights. It should be appreciated that, in the alternative to the set screw 112, any type of locking mechanism can lock the front rest 88 with the sleeve 108.

The front rest 88 is rotatably coupled to the telescoping member 62 about the front rest axis F. More specifically, the front support 92 of the front rest 88 is rotatably disposed on the rod 110 such that the front rest 88 is rotatably coupled to the telescoping member 62. The rod 110 presents a distal end with the rod 110 partially disposed within the front support 92.

As discussed above, the front and rear rests 88, 90 are spaced along the longitudinal axis L and are mounted to the telescoping member 62 in fixed positions. As such, the front rest 88 and the rear rest 90 move with the telescoping member 62 as the telescoping member 62 moves along the longitudinal axis L between the retracted and extended positions relative to the longitudinal axis L. In use, the occupant fixes the rear rest 90 in one of the fixed positions along the aperture 86 of the telescoping member 62. With the constant distance between the front and rear rests 88, 90 properly configured, the occupant can rest the weapon 22 on the rear rest 90 and the front rest 88, as shown for example in FIG. 6, until the occupant desires to user the weapon 22.

In both the retracted position and each of the plurality of extended positions the front rest 88 is spaced from the rotational axis A. As such, the telescoping member 62 can telescope from the platform frame 60 and the platform 58 can be rotated about the rotational axis A by exerting a force on the front rest 88 with a front end of the weapon 22.

Figure 7:
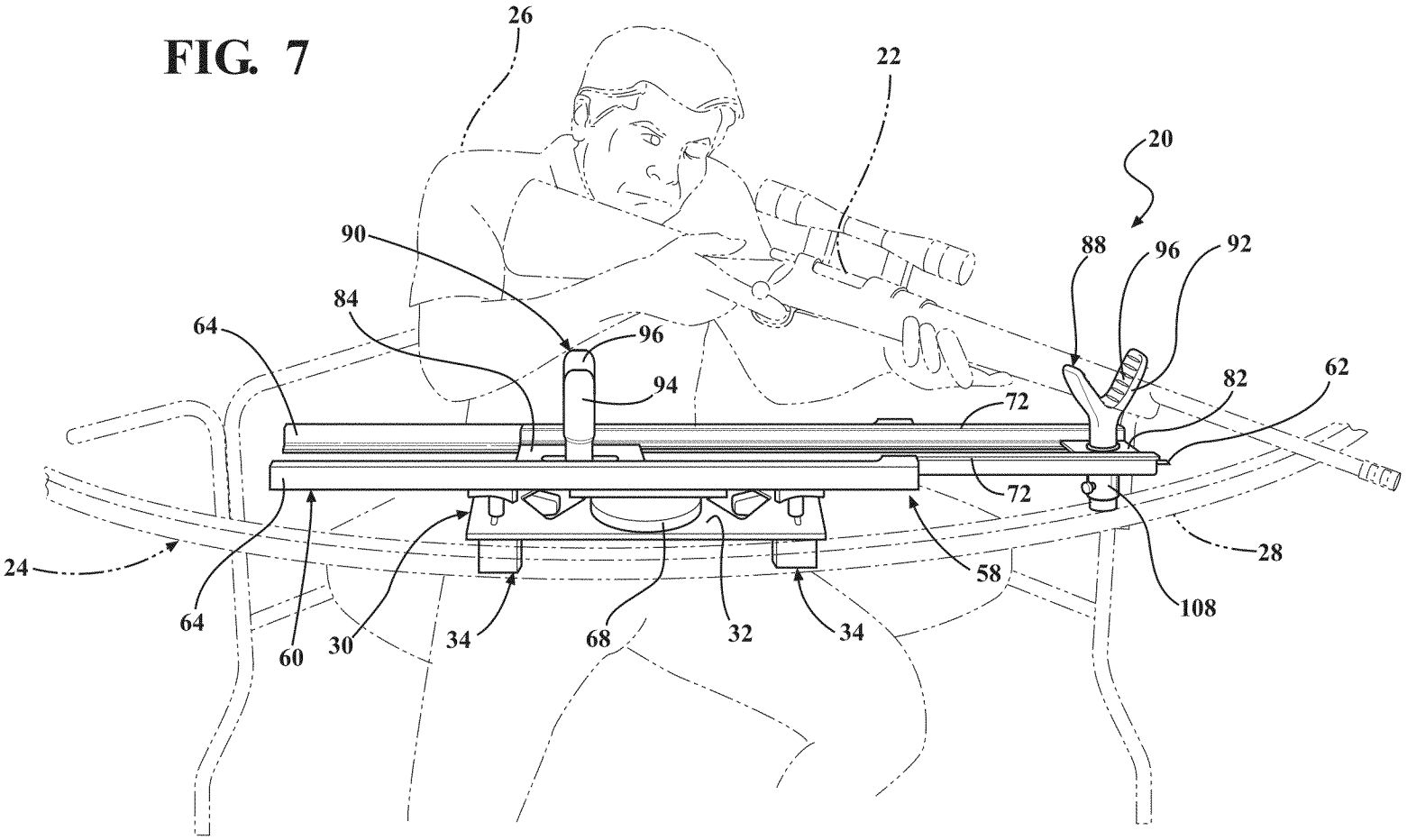
FIG. 7 is a perspective view of the shooting rest assembly supporting a weapon aimed in a first direction, specifically to the left of the occupant.

As shown in FIGS. 7 and 8, when the occupant wishes to aim the weapon 22, the occupant lifts a butt end of the weapon 22 from the rear rest 90 while maintaining the front end of the weapon 22 on the front rest 88. As the occupant moves the weapon 22 to aim, the force exerted on the front rest 88 by the front end of the weapon 22 causes the platform frame 60 to rotate relative to the base frame 32, the telescoping member 62 to telescope out of or into the platform frame 60 between the retracted and extended positions, and/or the front rest 88 to rotate relative to the telescoping member 62 with the weapon 22 remaining seated on the front rest 88. If the occupant wishes to again release the weapon 22 and rest the weapon 22 on both the front and rear rests 88, 90, the occupant moves the butt end of the weapon 22 back toward the rear rest 90 while maintaining the front end of the weapon 22 on the front rest 88. When over the rear rest 90, the occupant can rest the weapon 22 on the rear rest 90 and release the weapon 22.

The front and rear rests 88, 90 move together in unison with the telescoping member weapon 62, i.e., when the rear rest 90 is locked in a fixed position along the longitudinal axis L. As such, the weapon 22 can be rested on the front and rear rests 88, 90 when the telescoping member is disposed in any position relative to the platform frame 60 between the retracted and extended positions. At any time, if the occupant wishes to remove the weapon 22 from the shooting rest assembly 20, the occupant merely lifts the weapon 22 from both the front rest 88 and the rear rest 90.

The shooting rest assembly 20 advantageously holds the weapon 22 to reduce the risk of dropping the weapon 22 from the stand 24, which is elevated in the exemplary embodiment. By holding the weapon 22, the shooting rest assembly 20 also frees the hands of the occupant so that the occupant can more easily relax and/or can operate game calls or other game attractants. The shooting rest assembly 20 also holds the weapon 22 in a convenient location relative to the occupant such that the occupant can quickly and easily access the weapon 22 with limited movement. Further, by supporting the weapon 22 with the front rest 88, the weapon 22 is steadied to increase the accuracy of the shot at the target.

As set forth above, a second embodiment of the shooting rest assembly 114 is shown in FIG. 10. In the second embodiment, the rear rest 90 is fixed along the longitudinal axis L relative to the platform frame 60 and the front rest 88 is fixed along the longitudinal axis L relative to the telescoping member 62. The telescoping member 62 telescopes relative the platform frame 60 and the front rest 88 moves along the longitudinal axis L relative to the rear rest 90 when the telescoping member 62 telescopes relative to the platform frame 60.

Similar to the first embodiment, the rod 110 is adjustable along the front rest axis F for positioning the front rest 88 between the plurality of heights relative to the front cross-member 82. The set screw 112 is tightened to lock the front rest 88 in one of the plurality of heights and is loosened to adjust the front rest 88 between one of the plurality of heights. In the second embodiment, the telescoping member 62 is typically telescopically coupled to the platform frame 60 with a rod and bearing fit between the elongated members 72 and the rails 64.

In use, with the telescoping member 62 in the retracted position, the occupant can release the weapon 22 on the rear rest 90 and the front rest 88 until, for example, the game animal approaches. Similar to the first embodiment as shown in FIGS. 6-8, when the occupant wishes to aim the weapon 22, the occupant lifts the butt end of the weapon 22 from the rear rest 90 while maintaining the front end of the weapon 22 on the front rest 88. As the occupant moves the weapon 22 to aim, the platform frame 60 rotates relative to the base frame 32, the telescoping member 62 telescopes out of or into the platform frame 60 between the retracted and extended positions, and/or the front rest 88 rotates relative to the telescoping member 62 such that the weapon 22 remains seated on the front rest 88. If the occupant wishes to again release the weapon 22 and rest the weapon 22 on both the front and rear rests 88, 90, the occupant first moves the telescoping member 62 to the retracted position. With the telescoping member 62 in the retracted position, the occupant moves the butt end of the weapon 22 back toward the rear rest 90 while maintaining the front end of the weapon 22 on the front rest 88. When over the rear rest 90, the occupant can rest the weapon 22 on the rear rest 90 and release the weapon 22.

The base 30 of the shooting rest assembly 114 includes the distal clamps 48 briefly discussed in the first embodiment. As shown in FIG. 10, the distal clamps 48 include an adjustment member 118. The adjustment member 118 includes a longitudinal arm 120 and a transverse arm 122 transverse to the longitudinal arm 120. The longitudinal arm 120 extends into base frame 32 longitudinally along the base frame 32. A set knob 124 extends through the base frame 32 and selectively engages the longitudinal arm 120. The set knob 124 can be tightened or loosened to either lock the longitudinal arm 120 or allow movement of the longitudinal arm 120 relative to the base frame 32, respectively.

Each of the distal clamps 48 includes an angle bracket 126 having a first portion 128 parallel to the transverse arm 122 and a second portion 130 parallel to the longitudinal arm 120. A conduit 132 is longitudinally fixed to the first portion 128. The transverse arm 122 is slidably disposed within the conduit 132. An adjustment knob 134 extends through the conduit 132 and selectively engages the transverse arm 122. More specifically, the adjustment knob 134 can be tightened or loosened to either lock the angle bracket 126 or allow movement of the angle bracket 126 relative to the transverse arm 122, respectively.

The distal clamp 48 also includes a cup 136 fixed to the second portion 130 of the angle bracket 126. Furthermore, the distal clamp 48 includes a body 138 having a stud 140. The body 138 is disposed below the second portion 130 of the angle bracket 126, opposite the platform 58. The stud 140 is slidably and rotatably disposed within the cup, parallel to the transverse arm 122 of the adjustment member 118. A tightening screw 142 extends through the cup 136 and selectively engages the stud 140. More specifically, the tightening screw 142 can be tightened or loosened to either lock the stud 140 relative to the cup 136 or allow movement of the stud 140 relative to the cup 136, respectively.

The body 138 defines a pocket 144 and has a clamping surface 146 disposed within the pocket 144. Furthermore, a locking screw 148 having a locking surface 150 extends through the body 138 into the pocket 144. The locking surface 150 and the clamping surface 146 are parallel to each other. In use, the guard rail 28 of the stand 24 is disposed between the locking surface 150 and the clamping surface 146. The locking screw 148 can be tightened to sandwich the guard rail 28 between locking surface 150 and the clamping surface 146 for fixing the body 138 to the guard rail 28 or loosened to allow movement of the body 138 relative to the guard rail 28.

With the set knob 124, the adjustment knob 134, the tightening screw 142, and the locking screw 148 tightened, the distal clamp 48 couples the base frame 32 of the guard rail 28 of the stand 24. It should be appreciated that the distal clamp 48 shown in FIG. 10 can be used in combination with the clamps 34 set forth in the first embodiment.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A shooting rest assembly for supporting a weapon on a stand, said shooting rest assembly comprising:

a base having at least one clamp for coupling said base to the stand;

a platform frame rotatably coupled to said base about a rotational axis and extending between free ends, each free end spaced about said rotational axis;

a telescoping member being telescopically coupled to said platform frame, and configured to move along a longitudinal axis relative to said platform frame between a retracted position and an extended position, said telescoping member having a front portion and a rear portion spaced along said longitudinal axis; and a front rest disposed at said front portion and a rear rest disposed at said rear portion, said front rest and said rear rest being mounted to said telescoping member in fixed positions so that each of said front rest and said rear rest move with said telescoping member as said telescoping member moves along said longitudinal axis between said retracted and extended positions, said front portion and said rear portion of said telescoping member opposing each other about said rotational axis when said telescoping member is in said retracted position.

2. A shooting rest assembly as set forth in claim 1 wherein said rear rest is adjustable between a plurality of said fixed positions relative to said longitudinal axis.

3. A shooting rest assembly as set forth in claim 2 wherein said telescoping member and said rear rest are configured to retain said rear rest in one of said plurality of said fixed positions for maintaining a constant distance between said front rest and said rear rest as said telescoping member moves relative to said platform frame between said retracted position and said extended position to support the weapon between said retracted position and said extended position.

4. A shooting rest assembly as set forth in claim 2 further comprising a locking mechanism coupled to at least one of said telescoping member and said rear rest and movable between a locked position for fixing said rear rest in one of said plurality of said fixed positions and an unlocked position for adjusting said rear rest between said plurality of said fixed positions relative to said longitudinal axis.

5. A shooting rest assembly as set forth in claim 4 wherein said telescoping member defines an aperture elongated along said longitudinal axis and said rear rest includes a post slidably received in said aperture and capable of moving between said fixed positions when said locking mechanism is in said unlocked position.

6. A shooting rest assembly as set forth in claim 5 wherein said locking mechanism includes a threaded surface and a threaded nut threadedly engaging said threaded surface and movable between said locked and unlocked positions.

7. A shooting rest assembly as set forth in claim 1 wherein said front rest includes a front rest axis transverse to said longitudinal axis with said front rest rotatably coupled to said telescoping member about said front rest axis.

8. A shooting rest assembly as set forth in claim 1 wherein said front rest includes a front rest axis transverse to said longitudinal axis with said front rest adjustable along said front rest axis.

9. A shooting rest assembly as set forth in claim 1 wherein said rear rest includes a rear rest axis transverse to said longitudinal axis with said rear rest capable of being rotationally fixed to said telescoping member relative to said rear rest axis.

10. A shooting rest assembly as set forth in claim 1 wherein each of said platform frame and said base has a corresponding surface about said rotational axis with said corresponding surfaces abutting each other for supporting said platform frame on said base in various rotational positions.

11. A shooting rest assembly as set forth in claim 10 wherein one of said platform frame and said base has a spacer disposed between said platform frame and said base with said spacer presenting one of said corresponding surfaces.

12. A shooting rest assembly as set forth in claim 10 further comprising a pin coupling said platform frame and said base along said rotational axis and being rotatably coupled with at least one of said platform frame and said base.

13. A shooting rest assembly as set forth in claim 1 further comprising a spacer disposed about said rotational axis between said platform frame and said base with said spacer rotatably supporting said platform frame on said base.

14. A shooting rest assembly as set forth in claim 1 wherein said telescoping member includes an elongated member and said platform frame includes a rail with said rail telescopically receiving said elongated member.

15. A shooting rest assembly as set forth in claim 14 wherein said elongated member is further defined as two elongated members and said rail is further defined as two rails, said telescoping member further comprising at least one crossmember disposed between and fixed to said elongated members.

16. A shooting rest assembly as set forth in claim 1 further comprising an anti-friction device disposed between said platform frame and said telescoping member for reducing friction between said platform frame and said telescoping member.

17. A shooting rest assembly as set forth in claim 1 wherein each of said at least one clamp defines a channel for receiving a portion of the stand, said clamp having a tightening surface disposed in said channel and a tightening member extending into said channel opposite said tightening surface for sandwiching the stand between said tightening member and said tightening surface.

18. A shooting rest assembly as set forth in claim 1 wherein said base defines a slot and said at least one clamp includes a locking member extending through said slot to selectively adjust and fix said clamp relative to said base.

19. A shooting rest assembly for supporting a weapon on a stand, said shooting rest assembly comprising:

a base having at least one clamp for coupling said base to the stand and said base defining a slot to selectively adjust and fix said clamp relative to said base;

a platform frame rotatably coupled to said base about a rotational axis and extending between free ends, each free end spaced about said rotational axis;

a telescoping member being telescopically coupled to said platform frame, and configured to move along a longitudinal axis relative to said platform frame between a retracted position and an extended position, said telescoping member having a front portion and a rear portion spaced along said longitudinal axis; and a front rest disposed at said front portion and a rear rest disposed at said rear portion, said front rest and said rear rest being mounted to said telescoping member in fixed positions so that each of said front rest and said rear rest move with said telescoping member as said telescoping member moves along said longitudinal axis between said retracted and extended positions, said front portion and said rear portion of said telescoping member opposing each other about said rotational axis when said telescoping member is in said retracted position;

said front rest including a front rest axis transverse to said longitudinal axis with said front rest rotatably coupled to said telescoping member about said front rest axis.

20. A shooting rest assembly as set forth in claim 19 wherein each of said platform and said base has a corresponding surface about said rotational axis with said corresponding surfaces abutting each other for supporting said platform on said base in various rotational positions.

21. A shooting rest as set forth in claim 1 wherein said base is elongated along a base axis and said at least one clamp is further defined as two clamps spaced from each other along the base axis.

22. A shooting rest as set forth in claim 19 wherein said base is elongated along a base axis and said at least one clamp is further defined as two clamps spaced from each other along the base axis.

* * * * *